US011255605B1

(12) United States Patent
Mair

(10) Patent No.: US 11,255,605 B1
(45) Date of Patent: Feb. 22, 2022

(54) COSMETIC BRUSH DRYER

(71) Applicant: Terrell Mair, Boston, MA (US)

(72) Inventor: Terrell Mair, Boston, MA (US)

( * ) Notice: Subject to any disclaimer, the term of this patent is extended or adjusted under 35 U.S.C. 154(b) by 81 days.

(21) Appl. No.: 16/860,159

(22) Filed: Apr. 28, 2020

(51) Int. Cl.

| | |
|---|---|
| ***F26B 3/04*** | (2006.01) |
| ***A46B 17/06*** | (2006.01) |
| ***F26B 9/00*** | (2006.01) |
| ***F26B 21/02*** | (2006.01) |
| ***A46B 17/02*** | (2006.01) |

(52) U.S. Cl.
CPC ..... *F26B 3/04* (2013.01); *A46B 17/02* (2013.01); *A46B 17/06* (2013.01); *F26B 9/003* (2013.01); *F26B 21/02* (2013.01); *A46B 2200/1046* (2013.01)

(58) Field of Classification Search
CPC . F26B 3/04; F26B 21/02; A46B 17/02; A46B 17/06; A46B 2200/1046
USPC ..... 34/443
See application file for complete search history.

(56) References Cited

U.S. PATENT DOCUMENTS 586,404 A * 7/1897 Tyler et al. ..... D06F 3/00 68/63
3,129,451 A * 4/1964 Colaianni ..... A46D 9/04 15/303
3,982,296 A * 9/1976 Russo ..... A45D 24/46 15/38
4,403,364 A * 9/1983 Schroeder ..... A46B 17/06 15/38
5,259,406 A * 11/1993 Hofmann ..... A46B 17/06 134/103.2
5,625,960 A * 5/1997 Fujita ..... F26B 9/003 34/80
D516,257 S * 2/2006 Brackett ..... D32/1
7,086,112 B2 * 8/2006 Smith ..... A46B 17/06 15/21.1
7,451,772 B2 * 11/2008 Gilbert ..... A61L 2/025 134/110
7,458,944 B2 * 12/2008 Liste ..... A45D 34/04 601/137
9,067,462 B1 6/2015 Pressler
9,277,805 B2 * 3/2016 Baker ..... A46B 17/06
9,380,860 B1 * 7/2016 Taylor ..... A46B 13/008
D764,709 S 8/2016 Filho
(Continued)

FOREIGN PATENT DOCUMENTS

DE 10148933 A1 * 4/2003 ..... A45D 34/04
JP 5951497 B2 * 7/2016 ..... A46B 17/06
(Continued)

*Primary Examiner* — Stephen M Gravini
(74) *Attorney, Agent, or Firm* — Kyle A. Fletcher, Esq.

(57) ABSTRACT

The cosmetic brush dryer comprises a base unit, a water pan, a drain panel, one or more brush stands, and a top cover. The cosmetic brush dryer may dry one or more cosmetic brushes. As a non-limiting example, the one or more cosmetic brushes may be wet after being used and cleaned. An air moving device in the base unit may blow air through a heating element and the warm air produced may circulate around the one or more cosmetic brushes within the top cover. Water dripping from the one or more cosmetic brushes may pass through the drain panel and may be collected in the water pan. An electrical timer in the base unit may energize the air moving device and the heating element for a predetermined time interval.

19 Claims, 8 Drawing Sheets

(56) References Cited

U.S. PATENT DOCUMENTS

| | | | | |
|---|---|---|---|---|
| 9,468,287 | B1 | 10/2016 | Barnard | |
| 9,717,325 | B2 * | 8/2017 | Mongan | A47K 7/02 |
| 10,888,156 | B2 * | 1/2021 | Munoz | F26B 3/04 |
| 10,918,201 | B2 * | 2/2021 | Cosolito | B08B 11/02 |
| 2007/0235395 | A1 | 10/2007 | Mondale | |
| 2008/0060671 | A1 * | 3/2008 | Ruffin | A45D 27/46 132/292 |
| 2018/0264875 | A1 | 9/2018 | Mongan | |

FOREIGN PATENT DOCUMENTS

| | | | | |
|---|---|---|---|---|
| WO | WO-2007016586 | A1 * | 2/2007 | A61L 2/025 |
| WO | WO-2011067677 | A3 * | 10/2011 | A46B 17/06 |
| WO | 2018170496 | | 9/2018 | |

* cited by examiner

COSMETIC BRUSH DRYER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of beauty accessories, more specifically, a cosmetic brush dryer.

SUMMARY OF INVENTION

The cosmetic brush dryer comprises a base unit, a water pan, a drain panel, one or more brush stands, and a top cover. The cosmetic brush dryer may dry one or more cosmetic brushes. As a non-limiting example, the one or more cosmetic brushes may be wet after being used and cleaned. An air moving device in the base unit may blow air through a heating element and the warm air produced may circulate around the one or more cosmetic brushes within the top cover. Water dripping from the one or more cosmetic brushes may pass through the drain panel and may be collected in the water pan. An electrical timer in the base unit may energize the air moving device and the heating element for a predetermined time interval.

An object of the invention is to dry one or more cosmetic brushes.

Another object of the invention is to provide a base comprising an air moving device and a heating element to circulate warm air around cosmetic brushes enclosed by a top cover.

A further object of the invention is to provide a water pan for collecting water that drips from the brushes.

Yet another object of the invention is to provide a heat control to determine the degree of heating and a timer to energize the air moving device and the heater for a predetermined time interval.

These together with additional objects, features and advantages of the cosmetic brush dryer will be readily apparent to those of ordinary skill in the art upon reading the following detailed description of the presently preferred, but nonetheless illustrative, embodiments when taken in conjunction with the accompanying drawings.

In this respect, before explaining the current embodiments of the cosmetic brush dryer in detail, it is to be understood that the cosmetic brush dryer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the cosmetic brush dryer.

It is therefore important that the claims be regarded as including such equivalent construction insofar as they do not depart from the spirit and scope of the cosmetic brush dryer. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
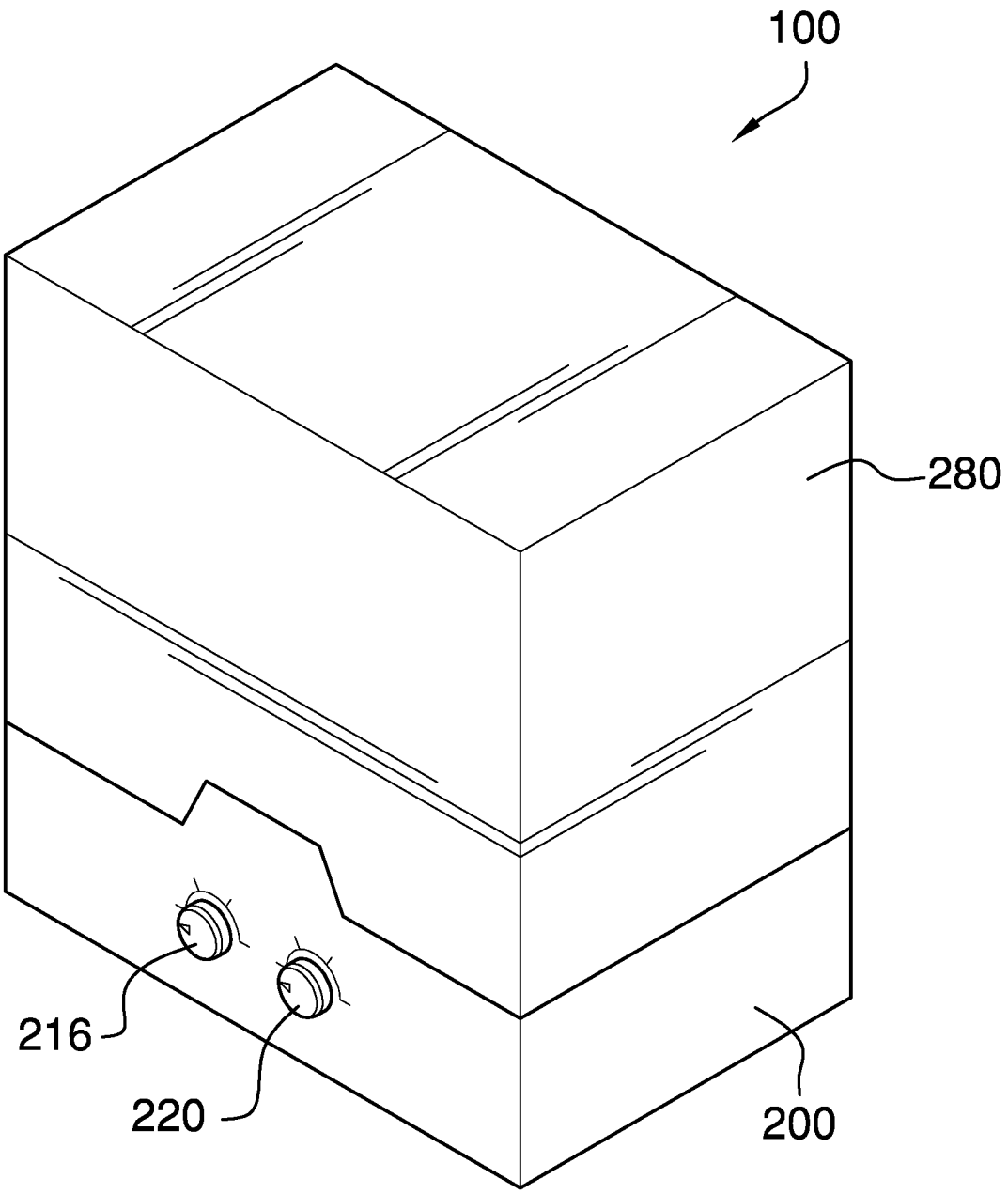
FIG. 1 is an isometric view of an embodiment of the disclosure.
Figure 2:
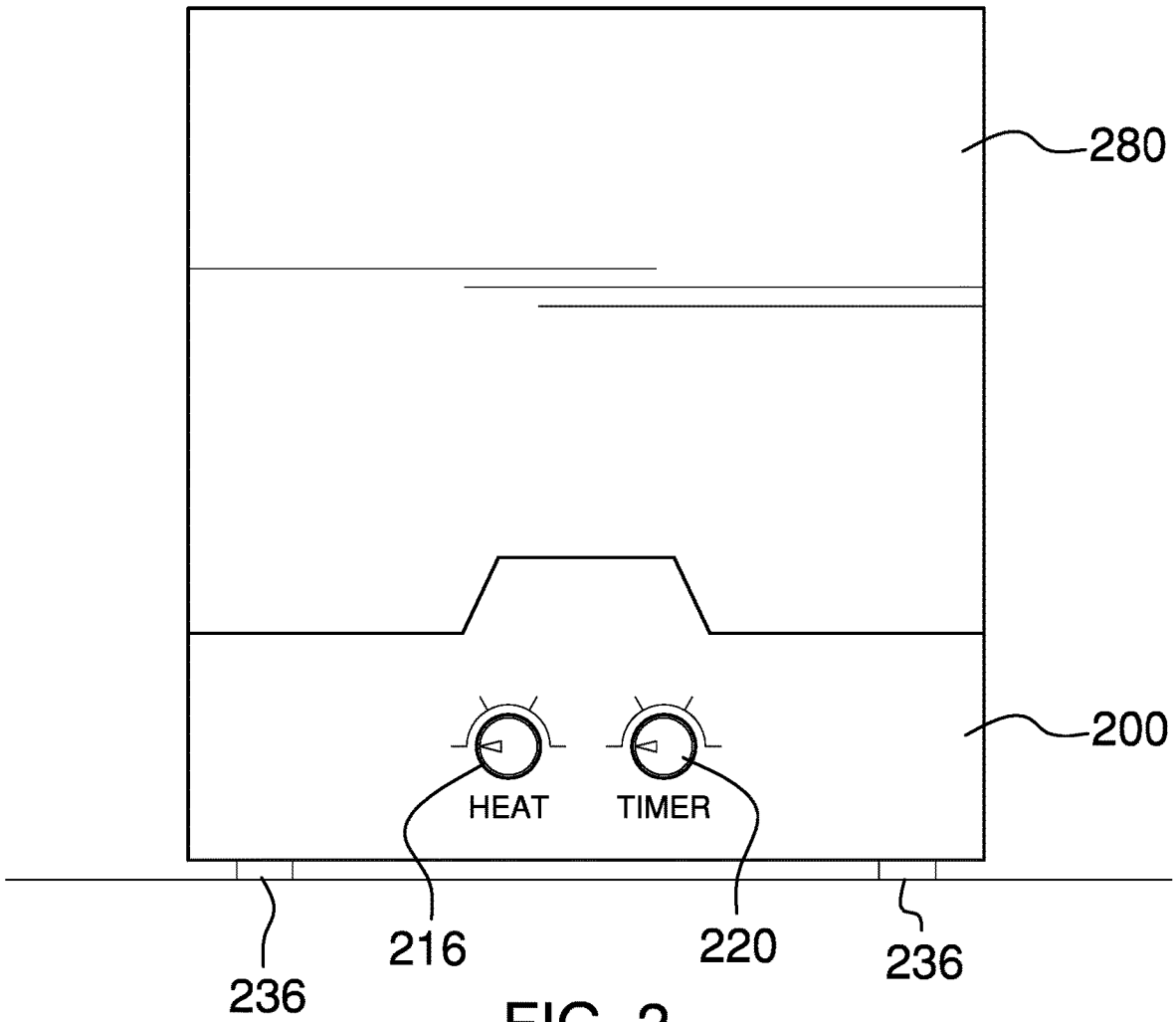
FIG. 2 is a front view of an embodiment of the disclosure.
Figure 3:
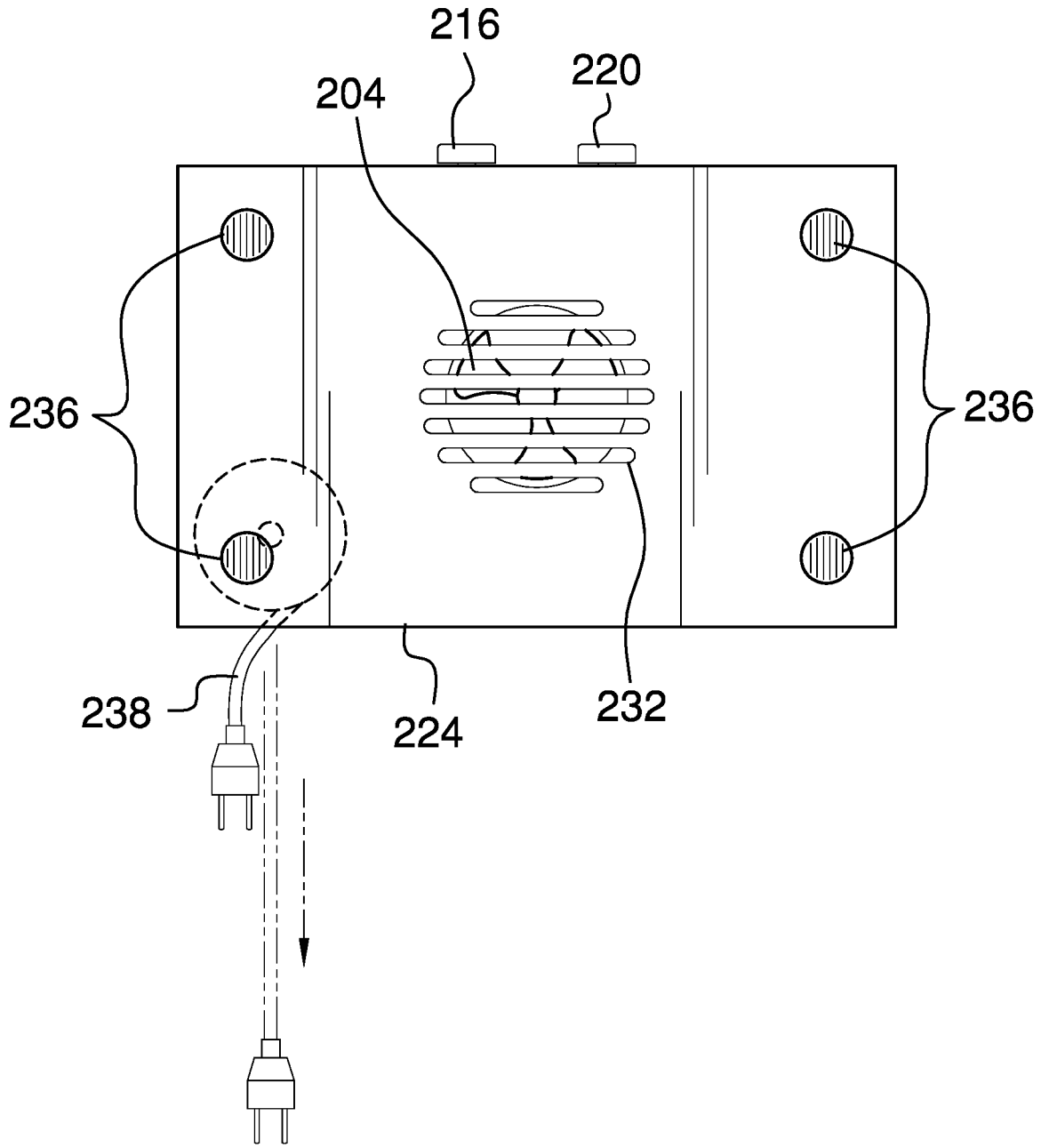
FIG. 3 is a bottom view of an embodiment of the disclosure.
Figure 4:
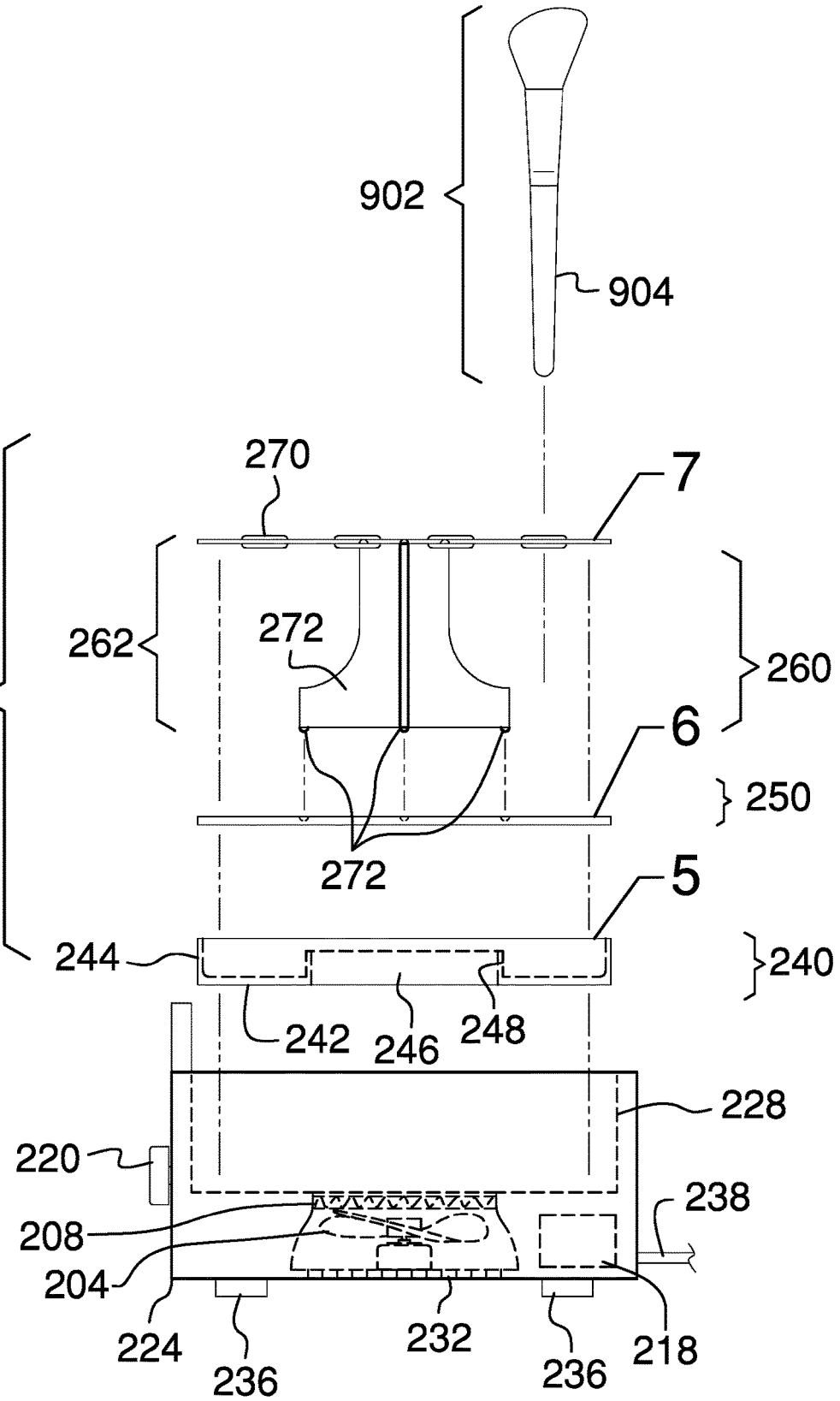
FIG. 4 is an exploded side view of an embodiment of the disclosure.
Figure 5:
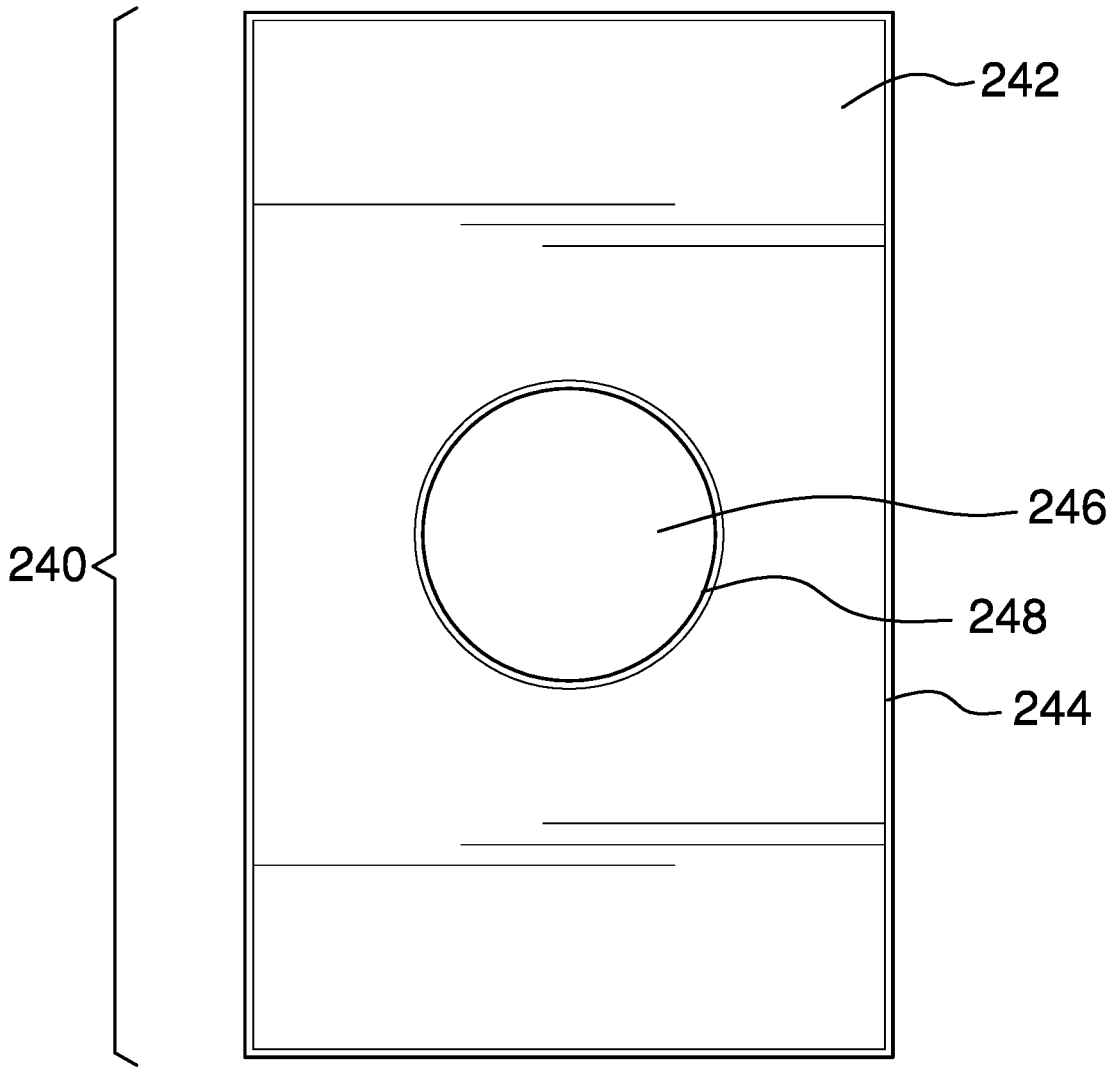
FIG. 5 is a detail top view of an embodiment of the disclosure illustrating the water pan shown in FIG. 4.
Figure 6:
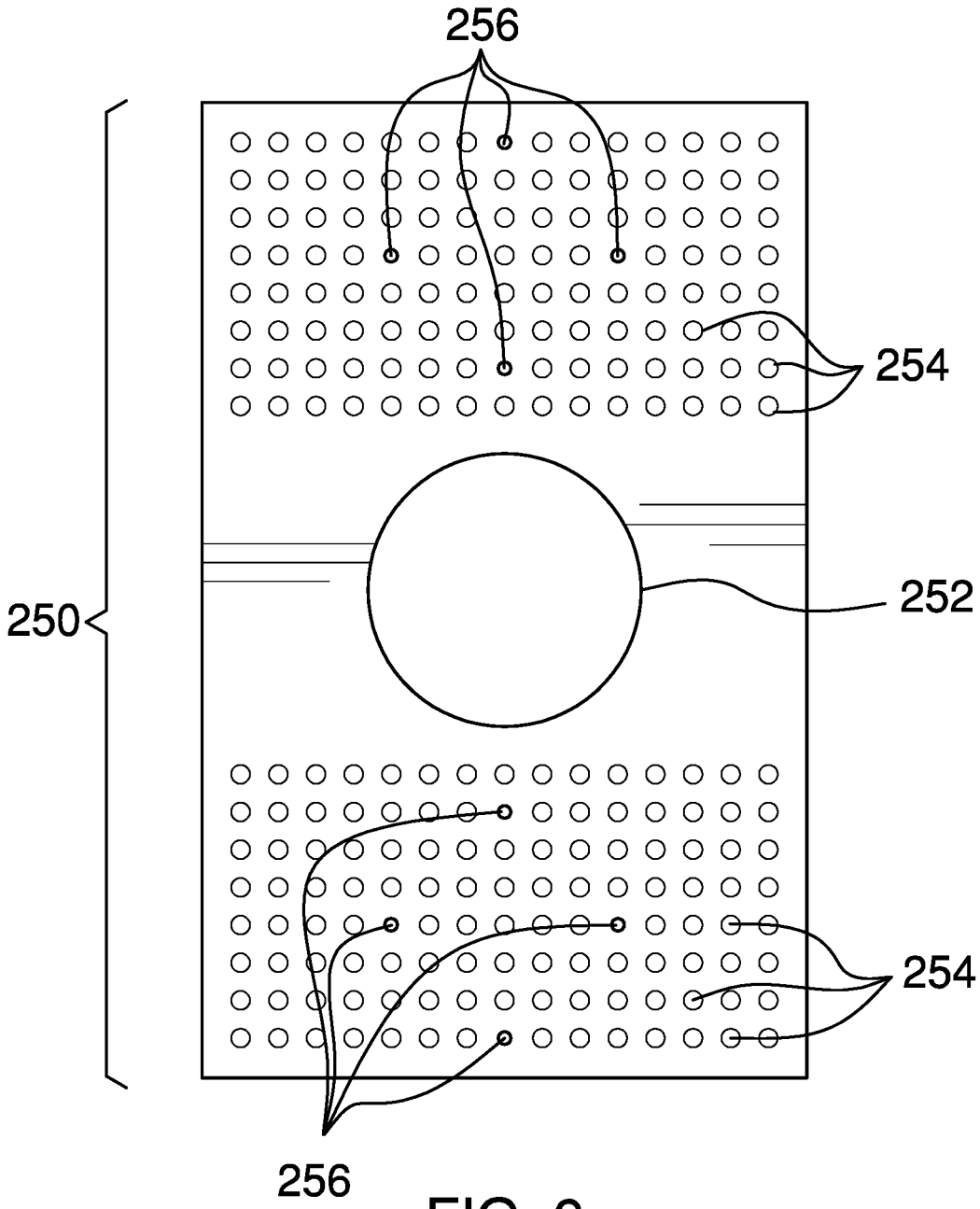
FIG. 6 is a detail top view of an embodiment of the disclosure illustrating the drain panel pain shown in FIG. 4.
Figure 7:
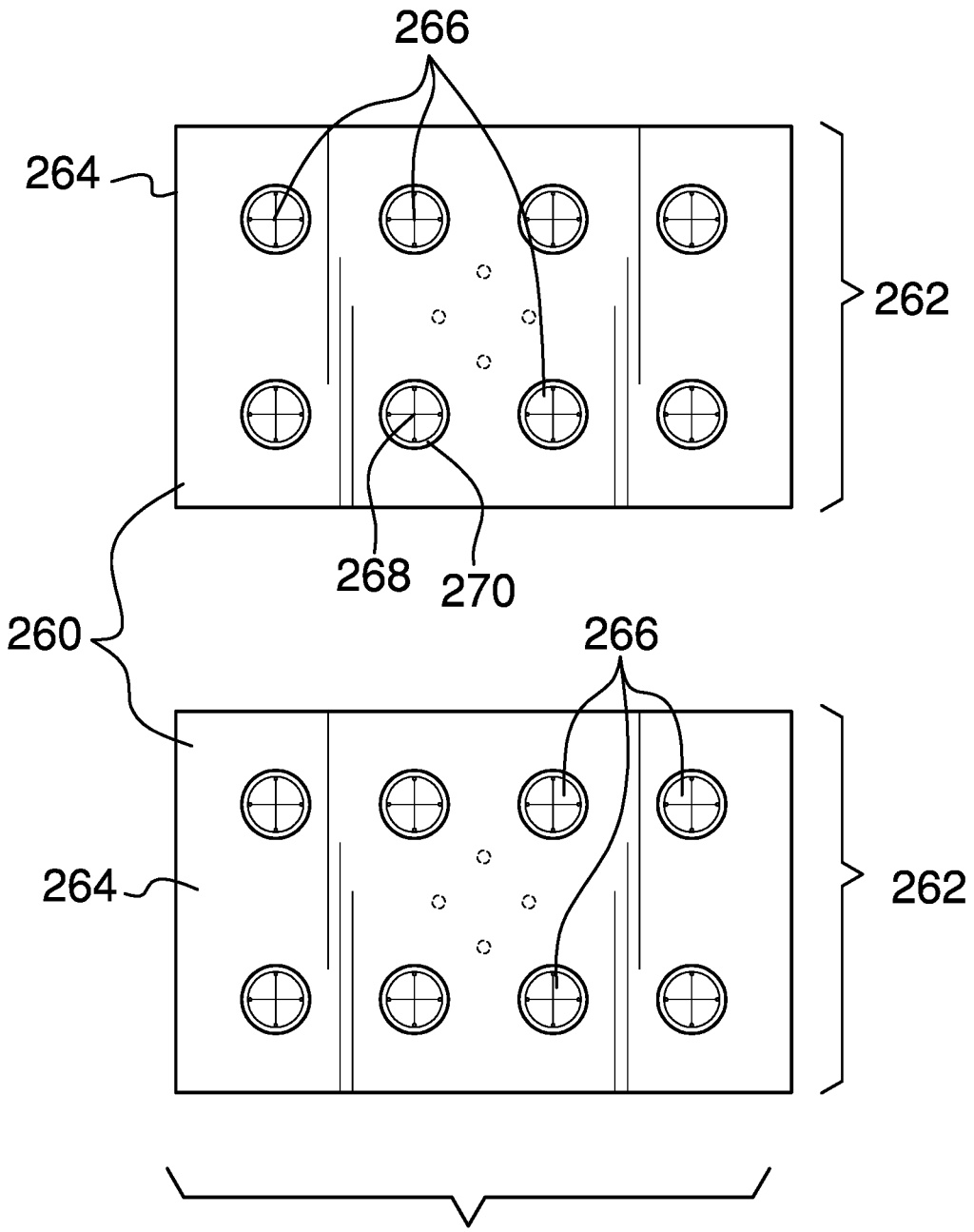
FIG. 7 is a detail top view of an embodiment of the disclosure illustrating the one or more brush stands shown in FIG. 4.
Figure 8:
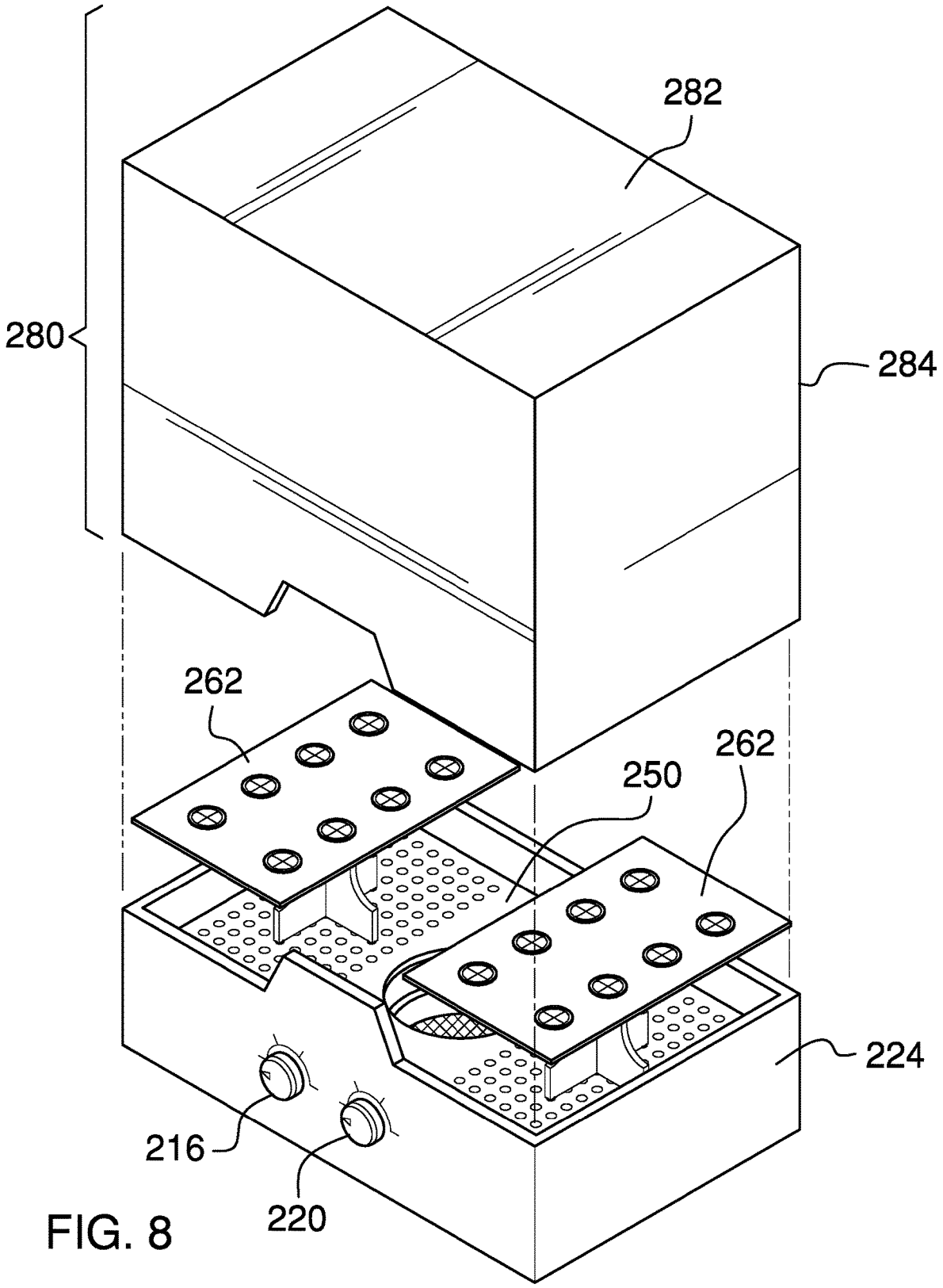
FIG. 8 is an isometric view of an embodiment of the disclosure illustrating the top cover removed.

Detailed reference will now be made to a first potential embodiment of the disclosure, which is illustrated in FIGS. 1 through 8.

The cosmetic brush dryer 100 (hereinafter invention) comprises a base unit 200, a water pan 240, a drain panel 250, one or more brush stands 260, and a top cover 280. The invention 100 may dry one or more cosmetic brushes. As a non-limiting example, the one or more cosmetic brushes may be wet after being used and cleaned. An air moving device 204 in the base unit 200 may blow air through a heating element 208 and the warm air produced may circulate around the one or more cosmetic brushes within the top cover 280. Water dripping from the one or more cosmetic brushes may pass through the drain panel 250 and may be collected in the water pan 240. An electrical timer 212 in the base unit 200 may energize the air moving device 204 and the heating element 208 for a predetermined time interval.

The base unit 200 may comprise the air moving device 204, the heating element 208, the electrical timer 212, a heat control 216, a timer control 220, a power cord 238, and a base enclosure 224. The base unit 200 may house the air moving device 204 and the heating element 208. The base unit 200 may be placed on a counter or other horizontal workspace. The top of the base unit 200 may support the water pan 240 and the top cover 280.

The air moving device 204 may move air into the base unit 200 via an air vent 232 located on the base enclosure 224 and up through the heating element 208 located at the top of the base enclosure 224 when the air moving device 204 is energized. The heating element 208 may heat air passing through the heating element 208 when the heating element 208 is energized. The degree of heating produced by the heating element 208 may be established by using the heat control 216. The air moving device 204 and the heating element 208 may be energized when the electrical timer 212 is in an ON state and may be de-energized when the electrical timer 212 is in an OFF state.

The electrical timer 212 may close an electrical circuit while in the ON state and may electrically couple the air moving device 204 and the heating element 208 to the power cord 238. The electrical timer 212 may open the electrical circuit when in the OFF state and may electrically decouple the air moving device 204 and the heating element 208 from the power cord 238. The electrical timer 212 may remain in the ON state for the predetermined time interval. The predetermined time interval may be established by using the timer control 220. The electrical timer 212 may return to the OFF state at the end of the predetermined time interval. In some embodiments, the heat control 216 and the timer control 220 may be accessible on the front of the base enclosure 224.

The power cord 238 may be extended from within the base unit 200 by pulling on the power cord 238. The power cord 238 may be plugged into a wall outlet to power the base unit 200. In some embodiments, the power cord 238 may retract into the base unit 200 using a spring-loaded reel when the power cord 238 is unplugged.

The base enclosure 224 may comprise a pan recess 228, the air vent 232, and a plurality of feet 236. The base enclosure 224 may be a housing for the air moving device 204, the heating element 208, and the power cord 238. The pan recess 228 located at the top of the base enclosure 224 may support the water pan 240. The top of the base enclosure 224 may removably couple to the bottom of the top cover 280. The air vent 232 may allow air to be drawn into the base enclosure 224. The plurality of feet 236 may prevent the bottom of the base enclosure 224 from marring the surface that the base enclosure 224 rests upon.

The water pan 240 may collect water that drips from the one or more cosmetic brushes. The water pan 240 may be removable from the base enclosure 224 such that the collected water may be disposed of. The water pan 240 may comprise a pan bottom 242, pan side walls 244, and a pan aperture 246. The bottoms of the pan side walls 244 may be coupled to the pan bottom 242 to form a watertight container. The pan aperture 246 located on the pan bottom 242 may be surrounded by raised aperture walls 248 such that water does not exit from the water pan 240 via the pan aperture 246. The pan aperture 246 may be positioned to align with the air moving device 204 such that the air moving device 204 may blow air up through the water pan 240.

The drain panel 250 may cover the water pan 240 and may support the one or more brush stands 260. The drain panel 250 may comprise a central air aperture 252, a plurality of drain apertures 254, and a plurality of stand apertures 256. The central air aperture 252 may be positioned to align with the air moving device 204 such that the air moving device 204 may blow air up through the drain panel 250. The plurality of drain apertures 254 may allow water that falls onto the drain panel 250 to pass through the drain panel 250 into the water pan 240. The plurality of drain apertures 254 may be distributed over the drain panel 250 in positions beneath the one or more brush stands 260. The plurality of stand apertures 256 may prevent the one or more brush stands 260 from moving horizontally. The plurality of stand apertures 256 may be positioned in locations that correspond to the position of a plurality of downward projections 274 on the one or more brush stands 260 such that the plurality of downward projections 274 drop into the plurality of stand apertures 256 to hold the one or more brush stands 260 in place.

The one or more brush stands 260 may be holders for the one or more cosmetic brushes. The one or more brush stands 260 may rest upon the drain panel 250 and may fit under the top cover 280 when the top cover 280 is in place. An individual brush stand 262 selected from the one or more brush stands 260 may comprise a brush panel 264 and a standoff 272. The brush panel 264 may be held in an elevated position above the drain panel 250 by the standoff 272.

The brush panel 264 may comprise a plurality of brush apertures 266. Each of the plurality of brush apertures 266 may hold an individual cosmetic brush 902. An individual brush aperture 268 selected from the plurality of brush apertures 266 may comprise a grommet 270 which lines the individual brush aperture 268 and which prevents the individual cosmetic brush 902 from slipping through the individual brush aperture 268.

The standoff 272 may lift the brush panel 264 such that a handle 904 of the individual cosmetic brush 902 may extend below the plane of the brush panel 264 when the individual cosmetic brush 902 is placed into one of the plurality of brush apertures 266. The plurality of downward projections 274 on the bottom of the standoff 272 may couple with the plurality of stand apertures 256 on the drain panel 250 to hold the individual brush stand 262 in place.

The top cover 280 may removably couple to the base unit 200 to retain warm air produced by the air moving device 204 and the heating element 208. The top cover 280 may comprise a top surface 282 and top cover side walls 284. The top surface 282 may couple to the top of the top cover side walls 284 to form a hollow interior. The one or more cosmetic brushes, loaded onto the one or more brush stands 260, may be located inside of the hollow interior when the top cover 280 is in place on the base unit 200. Warm air may circulate around the one or more cosmetic brushes within the hollow interior of the top cover 280.

In use, the one or more cosmetic brushes may be used, cleaned, and placed into the plurality of brush apertures 266 located on the one or more brush stands 260. The top cover 280 may be placed on the base unit 200 to enclose the one or more cosmetic brushes. With the power cord 238 plugged into a wall outlet, the heat control 216 may be used to select the degree of heating produced by the heating element 208 and the timer control 220 may be used to select the predetermined time interval of operation. The air moving device 204 may move air up through the heating element 208 and into the top cover 280 where the air may dry the one or more cosmetic brushes. Any water that drips from the one or more cosmetic brushes may pass through the drain panel 250 and may collect in the water pan 240. After the predetermined time interval, the top cover 280 may be removed and the one or more cosmetic brushes may be removed and stored, if desired. The one or more brush stands 260 and the drain panel 250 may be removed from the base unit 200. The water pan 240 may be removed and the water may be disposed of before replacing the water pan 240.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface. Aperture may be synonymous with hole, slit, crack, gap, slot, or opening.

As used in this disclosure, a "brush" may be a device comprising a plurality of bristles set into a handle or a base that is used for grooming, sweeping, smoothing, scrubbing, cleaning, or painting.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", may refer to connecting, either directly or indirectly, and does not necessarily imply a mechanical connection.

As used herein, the word "desired" may refer to a specific value or action within a range of supported values or action. A "desired" value or action may indicate that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used herein, "energize" and/or "energization" refer to the application of an electrical potential to a system or subsystem.

As used in this disclosure, a "fan" may be a mechanical device with rotating blades that is used to create a flow or current of air.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "heating element" may be a resistive wire that is used to convert electrical energy into heat. As non-limiting examples, common metals used to form heating elements include a combination of nickel and chromium, a combination of iron, chromium and aluminum, a combination of copper, nickel, iron, and manganese, or platinum.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "housing" may be a rigid or semi-rigid casing that encloses and protects one or more devices.

As used in this disclosure, the word "interior" may be used as a relational term that implies that an object is located or contained within the boundary of a structure or a space.

As used herein, "reel" may refer to a cylindrical object with side walls around which a wire, filament, thread, cord, cable, string, line, rope, hose, tubing, or other rope-like object is wound.

As used herein, the word "watertight" may refer to a barrier that is impermeable to water.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cosmetic brush dryer comprising:

a base unit, a water pan, a drain panel, one or more brush stands, and a top cover;

wherein the cosmetic brush dryer dries one or more cosmetic brushes;

wherein an air moving device in the base unit blows air through a heating element and a warm air produced circulates around the one or more cosmetic brushes within the top cover;

wherein water dripping from the one or more cosmetic brushes passes through the drain panel and is collected in the water pan;

wherein an electrical timer in the base unit energizes the air moving device and the heating element for a predetermined time interval.

2. The cosmetic brush dryer according to claim 1 wherein the base unit comprises the air moving device, the heating element, the electrical timer, a heat control, a timer control, a power cord, and a base enclosure;

wherein the base unit houses the air moving device and the heating element;

wherein a top of the base unit supports the water pan and the top cover.

3. The cosmetic brush dryer according to claim 2 wherein the air moving device moves air into the base unit via an air vent located on the base enclosure and up through the heating element located at a top of the base enclosure when the air moving device is energized.

4. The cosmetic brush dryer according to claim 3 wherein the heating element heats air passing through the heating element when the heating element is energized;

wherein a degree of heating produced by the heating element is established by using the heat control.

5. The cosmetic brush dryer according to claim 4 wherein the air moving device and the heating element are energized when the electrical timer is in an ON state and are de-energized when the electrical timer is in an OFF state.

6. The cosmetic brush dryer according to claim 5 wherein the electrical timer closes an electrical circuit while in the ON state and electrically couples the air moving device and the heating element to the power cord;

wherein the electrical timer opens the electrical circuit when in the OFF state and electrically decouples the air moving device and the heating element from the power cord;

wherein the electrical timer remains in the ON state for the predetermined time interval;

wherein the predetermined time interval is established by using the timer control;

wherein the electrical timer returns to the OFF state at the end of the predetermined time interval.

7. The cosmetic brush dryer according to claim 6 wherein the heat control and the timer control are accessible on a front of the base enclosure.

8. The cosmetic brush dryer according to claim 6 wherein the power cord is extended from within the base unit by pulling on the power cord;

wherein the power cord is plugged into a wall outlet to power the base unit.

9. The cosmetic brush dryer according to claim 8 wherein the power cord retracts into the base unit using a spring-loaded reel when the power cord is unplugged.

10. The cosmetic brush dryer according to claim 8 wherein the base enclosure comprises a pan recess, the air vent, and a plurality of feet;

wherein the base enclosure is a housing for the air moving device, the heating element, and the power cord;

wherein the pan recess located at the top of the base enclosure supports the water pan;

wherein the top of the base enclosure removably couples to a bottom of the top cover;

wherein the air vent allows air to be drawn into the base enclosure;

wherein the plurality of feet prevent a bottom of the base enclosure from marring a surface that the base enclosure rests upon.

11. The cosmetic brush dryer according to claim 10 wherein the water pan collects water that drips from the one or more cosmetic brushes;

wherein the water pan is removable from the base enclosure to dispose of the collected water;

wherein the water pan comprises a pan bottom, pan side walls, and a pan aperture;

wherein the bottoms of the pan side walls are coupled to the pan bottom to form a watertight container;

wherein the pan aperture located on the pan bottom is surrounded by raised aperture walls such that water does not exit from the water pan via the pan aperture;

wherein the pan aperture is positioned to align with the air moving device such that the air moving device blows air up through the water pan via the pan aperture.

12. The cosmetic brush dryer according to claim 11 wherein the drain panel covers the water pan and supports the one or more brush stands;

wherein the drain panel comprises a central air aperture, a plurality of drain apertures, and a plurality of stand apertures;

wherein the central air aperture is positioned to align with the air moving device such that the air moving device blows air up through the drain panel.

13. The cosmetic brush dryer according to claim 12 wherein the plurality of drain apertures allow water that falls onto the drain panel to pass through the drain panel into the water pan;

wherein the plurality of drain apertures are distributed over the drain panel in positions beneath the one or more brush stands;

wherein the plurality of stand apertures prevent the one or more brush stands from moving horizontally;

wherein the plurality of stand apertures are positioned in locations that correspond to a position of a plurality of downward projections on the one or more brush stands such that the plurality of downward projections drop into the plurality of stand apertures to hold the one or more brush stands in place.

14. The cosmetic brush dryer according to claim 13 wherein the one or more brush stands are holders for the one or more cosmetic brushes;

wherein the one or more brush stands rest upon the drain panel and fit under the top cover when the top cover is in place.

15. The cosmetic brush dryer according to claim 14 wherein an individual brush stand selected from the one or more brush stands comprises a brush panel and a standoff;

wherein the brush panel is held in an elevated position above the drain panel by the standoff.

16. The cosmetic brush dryer according to claim 15 wherein the brush panel comprises a plurality of brush apertures;

wherein each of the plurality of brush apertures hold an individual cosmetic brush.

17. The cosmetic brush dryer according to claim 16 wherein an individual brush aperture selected from the plurality of brush apertures comprises a grommet which lines the individual brush aperture and which prevents the individual cosmetic brush from slipping through the individual brush aperture.

18. The cosmetic brush dryer according to claim 17 wherein the standoff lifts the brush panel such that a handle of the individual cosmetic brush extends below a plane of the brush panel when the individual cosmetic brush is placed into one of the plurality of brush apertures;

wherein the plurality of downward projections on a bottom of the standoff couple with the plurality of stand apertures on the drain panel to hold the individual brush stand in place.

19. The cosmetic brush dryer according to claim 18 wherein the top cover removably couples to the base unit to retain warm air produced by the air moving device and the heating element;

wherein the top cover comprises a top surface and top cover side walls;

wherein the top surface couples to a top of the top cover side walls to form a hollow interior;

wherein the one or more cosmetic brushes, loaded onto the one or more brush stands, are located inside of the hollow interior when the top cover is in place on the base unit;

wherein warm air circulates around the one or more cosmetic brushes within the hollow interior of the top cover.

* * * * *